US011603726B2

(12) United States Patent
Harris et al.

(10) Patent No.: US 11,603,726 B2
(45) Date of Patent: Mar. 14, 2023

(54) IMPACT-TRIGGERED FLOATATION TOOL

(71) Applicant: Rubicon Oilfield International, Inc., Houston, TX (US)

(72) Inventors: Michael Harris, Houston, TX (US); Kenneth Anton, Houston, TX (US); Brandon Goodman, Houston, TX (US)

(73) Assignee: RUBICON OILFIELD INTERNATIONAL, INC., Houston, TX (US)

( * ) Notice: Subject to any disclaimer, the term of this patent is extended or adjusted under 35 U.S.C. 154(b) by 194 days.

(21) Appl. No.: 16/917,235

(22) Filed: Jun. 30, 2020

(65) Prior Publication Data

US 2021/0404278 A1 Dec. 30, 2021

(51) Int. Cl.

| | |
|---|---|
| ***E21B 29/00*** | (2006.01) |
| ***E21B 33/12*** | (2006.01) |
| *E21B 34/06* | (2006.01) |

(52) U.S. Cl.

CPC ..... *E21B 29/00* (2013.01); *E21B 33/12* (2013.01); *E21B 34/063* (2013.01)

(58) Field of Classification Search

CPC ..... E21B 33/12; E21B 34/063; E21B 2200/06
See application file for complete search history.

(56) References Cited

U.S. PATENT DOCUMENTS

| | | | |
|---|---|---|---|
| 5,479,986 | A | 1/1996 | Gano et al. |
| 7,090,027 | B1 | 8/2006 | Williams |
| 7,210,533 | B2 | 5/2007 | Starr et al. |
| 8,534,379 | B2 | 9/2013 | Giroux et al. |
| 9,279,295 | B2 | 3/2016 | Williamson et al. |
| 9,546,536 | B2 | 1/2017 | Schultz et al. |
| 9,593,542 | B2 | 3/2017 | Getzlaf et al. |
| 10,246,971 | B2 | 4/2019 | Doane et al. |
| 10,316,979 | B2 | 6/2019 | Petrowsky |
| 10,465,445 | B2 | 11/2019 | Getzlaf et al. |
| 10,683,728 | B2 | 6/2020 | Kellner et al. |
| 10,883,314 | B2 | 1/2021 | Getzlaf et al. |

(Continued)

OTHER PUBLICATIONS

Breakthru™ Casing Flotation Device, Nine Energy Service, Jul. 15, 2019, Retrieved from the Internet: URL: <https://nineenergyservice.com/assets/files/Nine-BreakThru-ProductSheet-v6.pdf>, [Retrieved on Dec. 1, 2020], 2 pages.

*Primary Examiner* — Robert E Fuller
*Assistant Examiner* — Lamia Quaim
(74) *Attorney, Agent, or Firm* — MH2 Technology Law Group LLP

(57) ABSTRACT

Disclosed is an apparatus and system, and a method of using the same, comprising An apparatus comprising: a first outer pipe; a central housing attached to the first outer pipe, an annular piston that can impact a brittle barrier, the annular piston comprising an impact surface; a brittle barrier, wherein the brittle barrier is separated from the impact surface by a distance, and wherein the brittle barrier comprises a set of materials; and a second outer pipe attached to the central housing, wherein the central housing is positioned between the first outer pipe and the second outer pipe; wherein the brittle barrier is positioned within one or more of the central housing and the second outer pipe; wherein the annular piston is attached to one or more of the first outer pipe and the central housing via a releasable fastener.

19 Claims, 6 Drawing Sheets

(56) References Cited

U.S. PATENT DOCUMENTS

| | | | | |
|---|---|---|---|---|
| 10,883,315 | B2 | 1/2021 | Getzlaf et al. | |
| 11,180,958 | B2 | 11/2021 | Getzlaf et al. | |
| 2009/0139720 | A1* | 6/2009 | Frazier | E21B 33/1204 166/135 |
| 2015/0226031 | A1* | 8/2015 | Hekelaar | E21B 31/107 166/374 |
| 2017/0022783 | A1* | 1/2017 | Yong | H04L 41/0213 |
| 2019/0352994 | A1* | 11/2019 | Giroux | E21B 33/1208 |
| 2019/0360301 | A1 | 11/2019 | Getzlaf et al. | |
| 2022/0178207 | A1 | 6/2022 | Getzlaf et al. | |

* cited by examiner

IMPACT-TRIGGERED FLOATATION TOOL

BACKGROUND

1. Field

This disclosure relates generally to mechanical devices and, more particularly, to subsurface float tools for oil production.

2. Background

Oil and gas production operations can include drilling lengthy bores including lateral bores from the surface to a target depth. Drilling fluid is used in this process to aid in operation of the drill bit and to circulate cuttings out of the hole. The bores are typically cased with casing joints telescopically and cemented into place to protect the bore from the environment and to stabilize the bore. In some operations, casing, production and completion strings are inserted and forced to the target depth to produce the drilled oil to the surface. The casing string, production string or other such string tends to sit on the bottom side of the lateral bore as it is forced toward its target depth. Difficulty in placing the string to its target depth can arise because the extreme length of lateral bores result in extreme frictional forces along the line sitting on the bottom side of the bore. The combined weight of the production string and the completion fluid, which can be of the order of 20 pounds per gallon, with potentially more than 4 gallons per foot depending on casing size, can be large and hinder positioning of the casing string at the desired predrilled depth. As such, there is a need for a device or method to reduce frictional forces along the string while allowing a seamless transition to fluid circulation thus facilitating the production of oil to the surface after string placement without the additional time consumption of drilling out additional tools.

SUMMARY

The following is a non-exhaustive listing of some aspects of the present techniques. These and other aspects are described in the following disclosure.

Some aspects include a floatation device that comprises a substantially cylindrical tool with an inner bore having a partition that separates the upstream and downstream portions of the bore. The partition is selectively activated to allow fluid communication between the upstream and downstream portion of the bore, the selective activation including an impact of a component against the barrier to shatter the barrier, and allowing the portion of pipe downstream of the tool to be air-filled and therefore comparatively light prior to the selective activation from the portion of the pipe upstream of the tool. Buoyant forces on the air-filled portion of the pipe downstream of the tool can help in reducing frictional forces on the pipe.

Some aspects include an apparatus comprising a first outer pipe; a central housing attached to the first outer pipe, an annular piston having a first end and a second end, the annular piston positioned at least in part inside the central housing, the annular piston comprising an impact surface: a brittle barrier, wherein the brittle barrier is separated from the impact surface by a distance, and wherein the brittle barrier comprises a set of materials; and a second outer pipe attached to the central housing, wherein the central housing is positioned between the first outer pipe and the second outer pipe; wherein the brittle barrier is positioned within one or more of the central housing and the second outer pipe; wherein the annular piston is attached to one or more of the first outer pipe and the central housing via a releasable fastener; and wherein the piston is moveable from a first position to a second position, the first position a distance from the brittle barrier and the second position resulting in an application of force from the impact surface to the brittle barrier.

Some aspects include the apparatus disclosed above, wherein: the central housing comprises a transition housing segment between a wider housing segment of the central housing and a narrower housing segment of central housing, wherein the inner diameter of the transition housing segment is less than the first inner diameter and greater than the second inner diameter; and the annular piston comprises a transition piston segment between a wider piston segment of the annular piston and a narrower piston segment of the annular piston, wherein the outer diameter of the transition piston segment is greater than the first outer diameter and less the second outer diameter.

Some aspects include the apparatus disclosed above, further comprising an inner bore within the central housing, first outer pipe, and second outer pipe wherein the annular piston and the central housing are shaped such that an empty space is formed between them, wherein the empty space is in fluid isolation from the inner bore.

Some aspects include the apparatus disclosed above, wherein the fasteners are releasable by an increase in pressure within the inner bore.

Some aspects include the apparatus disclosed above, wherein the brittle barrier comprises a tapered boundary, wherein a first end of the brittle barrier has a greater end than the second end of the brittle barrier.

Some aspects include the apparatus disclosed above, further comprising a frame, wherein the frame surrounds the brittle barrier.

Some aspects include the apparatus disclosed above, wherein the fasteners are releasable at a first pressure and the brittle barrier comprises a material that shatters at a pressure greater than the first pressure and less than 9000 psi.

Some aspects include the apparatus disclosed above, wherein the brittle barrier comprises an engineered glass that shatters into glass particulates, and wherein at least 10% of the glass particulates have a grain size less than 50 millimeters.

Some aspects include the apparatus disclosed above, wherein the impact surface comprises a set of protrusions, the protrusions comprising a plurality of metal pins, wherein each pin has a tip and a base, wherein the tip of each respective metal pin is narrower than the base of each respective metal pin.

Some aspects include the apparatus disclosed above, wherein the set of protrusions is distributed on the annular surface such that each azimuthal position of the annular piston intersects with a maximum of one protrusion of the set of protrusions.

Some aspects include the apparatus disclosed above, wherein the fastener is a shear pin.

Some aspects include the apparatus disclosed above, wherein the brittle barrier is fixed to the central housing or the second outer pipe.

Some aspects include the apparatus disclosed above, wherein the fastener releases at a pressure less than 8000 psi.

Some aspects include the apparatus disclosed above, wherein the impact surface comprises a set of protrusions, the set of protrusions formed the same material as the annular piston.

Additional teachings herein include a method comprising determining a disengagement pressure based on a set of fasteners that attaches an annular piston to an annular housing or a first outer pipe, wherein the annular piston is positioned at least in part inside an annular housing or a first outer pipe, the annular piston comprising an opening at a first end of the annular piston that permits a fluid to flow into a hollow volume of the annular piston, an opening at a second end of the annular piston that is permeable to fluids, and a set of protrusions attached to the second end of the annular piston facing away from the first end of the annular piston; and increasing a fluid pressure in the annular housing to be equal to or greater than the disengagement pressure to cause a disengagement of the annular piston from the annular housing or the first outer pipe, wherein: the increasing of the fluid pressure increases a net force experienced by the annular piston, and the disengagement of the annular piston from the annular housing or the first outer pipe permits the annular piston to move in a first direction that points from an axial position of the first end of the annular piston to an axial position of the second end of the annular piston to strike a brittle barrier with the set of protrusions, wherein the strike causes the brittle barrier to shatter.

Some aspects include the method disclosed above further comprising: determining whether the brittle barrier was shattered after the disengagement of the annular piston from the annular housing; and in response to a determination that the brittle barrier was not shattered after the disengagement of the brittle pipe, increasing the fluid pressure in the annular housing to be equal to or greater than a shatter pressure associated with the brittle barrier, wherein the shatter pressure is greater than the disengagement pressure.

Some aspects include the method disclosed above, further comprising: determining whether the brittle barrier was shattered; and in response to a determination that the brittle barrier was shattered, pouring cement into the borehole.

Some aspects include the method disclosed above wherein increasing the fluid pressure causes the brittle material to shatter into particles such that the majority of particles have a maximum diameter less than or equal to 50 millimeters.

Additional teachings herein include a system comprising a first outer pipe in a downhole environment, wherein the first outer pipe is filled with a liquid; a central housing attached to the first outer pipe an annular piston with a central bore, the annular piston positioned at least in part inside the central housing, and wherein the annular piston is attached to the central housing or the first outer pipe via a fastener, the annular piston and the central housing cooperatively shaped to form a hollow section in fluid isolation from the central bore, the annular piston comprising, an annular surface that at a second end of the annular piston, and an impact surface facing toward a brittle barrier; the brittle barrier in contact with the central housing or a second outer pipe, wherein the brittle barrier is separated from the impact surface by a distance, and wherein the brittle barrier comprises a set of materials; and a set of second outer pipes engaged to the central housing at an end of the central housing pipe that is opposite to the first outer pipe, wherein each of the set of second outer pipes is filled with one or more gases; and an assembly attached to the set of second outer pipes, wherein the assembly is adapted to prevent fluid flow into the second outer pipes.

Some aspects include variable activation of fasteners restraining a piston, including activation based on pressure increases, activation from electronic signals or otherwise computer controlled, such computer collocated or remote from the tool, activation based on physical manipulation of the pipe, tools or a subset thereof, activation based on movement of latches, threads and otherwise.

Some aspects include the system disclosed above, wherein an increase in pressure detaches the annular piston from the first outer pipe or the central housing.

BRIEF DESCRIPTION OF THE DRAWINGS

The above-mentioned aspects and other aspects of the present techniques will be better understood when the present application is read in view of the following figures in which like numbers indicate similar or identical elements.

Figure 1:
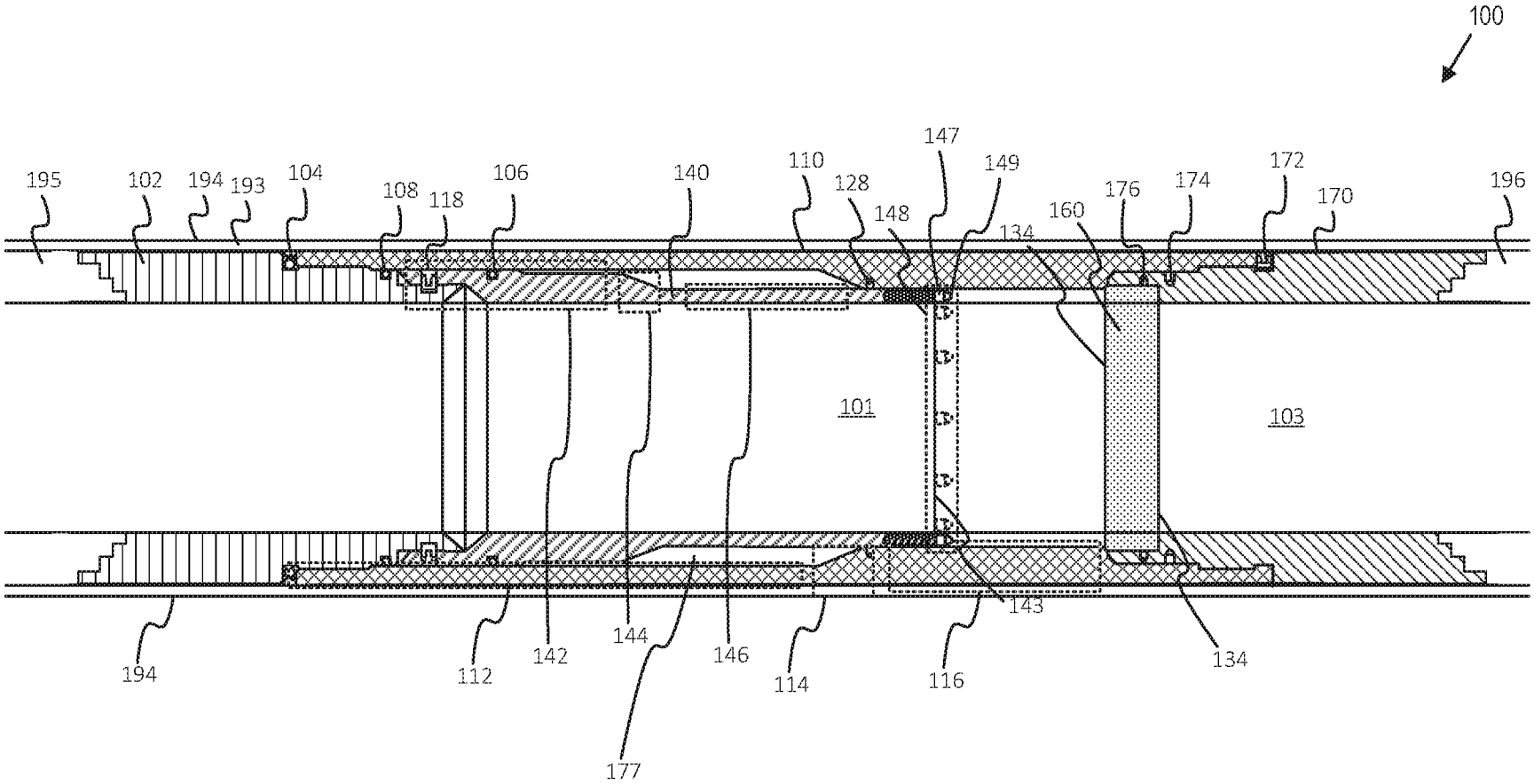
FIG. 1 is a diagram of a casing floatation device before pressure activation, in accordance with some embodiments.

While the present techniques are susceptible to various modifications and alternative forms, specific embodiments thereof are shown by way of example in the drawings and will herein be described in detail. The drawings may not be to scale. It should be understood, however, that the drawings and detailed description thereto are not intended to limit the present techniques to the particular form disclosed, but to the contrary, the intention is to cover all modifications, equivalents, and alternatives falling within the spirit and scope of the present techniques as defined by the appended claims.

DETAILED DESCRIPTION OF CERTAIN EMBODIMENTS

To mitigate the problems described herein, the inventors had to both invent solutions and, in some cases just as importantly, recognize problems overlooked (or not yet foreseen) by others in the field of floatation devices. Indeed, the inventors wish to emphasize the difficulty of recognizing those problems that are nascent and will become much more apparent in the future should trends in industry continue as the inventors expect. Further, because multiple problems are addressed, it should be understood that some embodiments are problem-specific, and not all embodiments address every problem with traditional systems described herein or provide every benefit described herein. That said, improvements that solve various permutations of these problems are described below.

Some embodiments include a downhole tool (i.e. downhole device) arranged to provide benefits including lessening weight in lateral bores and aiding in reducing friction experienced by components such as completion string, the production string, other pipes, the bottom hole assembly (BHA), or the like by increasing the ease of lowering components filled with air instead of liquids (often known as "floating"). As described in this disclosure, a pipe may include though not be limited to casing, string, or other hollow vessels capable of being used to transport fluids, where it should be understood that interactions with or operations performed on or by one type of pipe (e.g., casing) may be applicable to other types of pipe (e.g., string). In these embodiments, a tool is placed in operation by appropriate method, including by screw threads sized and positioned to mate with corresponding threads on adjacent portions of casing. In some deployments of the tool, it is placed in line with the completion string and forced into an open or cased drilled hole. In some embodiments, the tool is placed in line with cylindrical joints and lowered into the drilled hole. In many embodiments, the distal end of the line has a float shoe or float collar that prevents entry of fluid into the string from the distal end. In some embodiments, the position of the line downhole of the tool in accordance with the teachings herein has no drilling fluid during placement because of the fluid integrity between the tool under the teachings herein and the float equipment at the distal end of the line. The portion of the line above the tool has drilling fluid. In these embodiments, the tool comprises a barrier separating the downhole and upward sections.

An embodiment of a tool according to the methods taught herein comprises a hollow central bore through generally cylindrical components. The hollow central bore can be divided between an upstream and a downstream portion by a barrier that conditionally prevents and allows fluid communication between the upstream and downstream portion. In many embodiments, the barrier is selectively activated to change state from preventing to allowing fluid communication. The components are typically of a steel construction. The barrier can be constructed of other material, and in certain embodiments is made of material that is intended to shatter on impact with an activating portion of the tool. Other materials suitable with strength and heat resistant properties suitable for the applications described herein are appropriate.

In some embodiments a barrier is positioned in the bore of the tool under teachings herein to restrict the flow of fluid. The barrier is selectively movable or removable to allow fluid flow. In these embodiments, the barrier remains stationary and is impacted by a piston or sliding sleeve adapted to shatter the barrier. In certain embodiments, the barrier is constructed to be moved or removed upon or in reaction to a triggering event. The triggering event may include pressurizing the fluid within the production string to activate a piston. The piston may be specially configured to include portions that may impact the barrier to enhance the interaction, such as an impact, between the piston and the barrier. Alternatively or in addition, a triggering event can move a device including any impact surface to impact the barrier.

Movement of a piston may be triggered by an increase in fluid pressure in the bore of the tool. A pump or other external source of pressure can increase the fluid pressure within the bore above a threshold sufficient to release a securing device and allow lateral movement of the piston. The securing mechanism can be one or more detachable fasteners, including shear pins located between the outer housing of the tool and the piston. In some embodiments, the piston and the housing are shaped such that they cooperate to form a hollow volume in fluid isolation from both the inner bore and the annulus outside the tool. The hollow portion can be shaped in an elongated manner to mimic and to define the stroke of the piston. The hollow portion can be positioned and shaped such that upon an increase of internal pressure within the tool, the shear pins securing the piston to the surrounding casing receives a shearing force and upon reaching a target pressure, the shear force can be such that it the shear pins shear and allow lateral movement of a piston. The hollow portion tends to constrict under increased hydrostatic pressure and pressure differential between the inner bore and the hollow volume, and such constriction can allow for a lateral stroke of the piston. The movement of the piston can be triggered by various other means and the fasteners can be detached by other means. Without limitation, the piston can be initially held in place by threads such that rotation of the piston frees it for lateral motion. Alternatively or in addition, the piston can be initially held in place by latches or other restraining mechanism activated through different means, including electrical signal activating a mechanical restraint, increased pressure, rotation, dissolution of a restraining device through the use of appropriate fluids, or otherwise.

In some embodiments, a piston stroke length is set such that in the furthest extended position the piston or attachments thereto can impact a brittle barrier and travel sufficiently beyond the impact point to ensure sufficient breakage of the brittle barrier and complete removal of the brittle barrier from its seat. In these embodiments, the brittle barrier is sized, shaped, positioned, and made of such material that the impact of the piston upon the brittle barrier causes the brittle barrier to fail. Upon failure of the brittle barrier, the center bores above and below the brittle barrier are in fluid communication, and the fluid that is trapped above the brittle barrier can flow downward toward the bottom hole assembly or other portions of the distal end of the completion string or other such string on which the tool is utilized. An advantage of this operation is that the fluid is not present in the distal end of the completion string downstream of the tool under the teachings herein while the casing or completion string is being run, greatly reducing the weight of the string and reducing the hinderances caused by such weight, such as additional friction between the casing or completion string and the surrounding casing or uncased hole and allowing total or complete floatation of the tool and proximate joints thereto. Once the completion string is positioned within the hole and the brittle barrier is broken, the center bore can be filled with drilling mud or other fluid and regular circulation of fluids within the string can begin or continue.

With respect to FIG. 1, an embodiment of the floatation device 100 according to certain teachings of this disclosure is shown and described herein in summary form. An upper sub 102 is positioned upstream of the housing 110 and the lower sub 170 is positioned downstream of the housing 110. A piston 140 may be positioned within the housing 110. A hollow volume 177 may be formed between the piston 140 and the housing 110. The hollow volume 177 may be substantially sealed from an annulus 193 (as defined by a borehole wall 194) and a volume of the inner bore section 101. The hollow volume 177 may be isolated such that fluid from the annulus 193 and the volume of the inner bore section 101 cannot significantly penetrate the hollow volume 177 even upon substantial pressure increase within the inner bore. The brittle barrier 160 is positioned downstream of the piston 140. The piston 140 may be adapted to receive breaking pins 148 on the distal end of the piston 140. These breaking pins 148 are secured in the end of the piston 140 and directed toward the brittle barrier 160. The breaking pins 148 are arranged around the circumference of the piston 140 in a ring-like arrangement. The piston 140 may be secured in its position by one or more shear screws 118, sized, shaped and positioned to receive a shear force upon the application of increased fluid pressure within the inner bore of the floatation device 100. It should be understood that the shear screws described in this disclosure may be replaced with other fasteners having a designed disengagement force, such as shear pins. In other embodiments, the piston 140 is secured by other means that are actuatable, such as shear rings. In some embodiments, but not necessarily the extent of the scope of all claims hereunder, there is no shear pin or shear screw connecting the brittle barrier 160 to any other component. Instead the brittle barrier 160 is seated semi-permanently near the interface between the housing 110 and the lower sub 170, and the brittle barrier 160 is not designed in some embodiments to release at a particular pressure, but upon physical impact from a sliding sleeve or piston. Interfaces between the various components, such as the upper sub 102 and the housing 110, and the housing 110 and the piston 140 can have their fluid integrity enhanced through the use of O-rings 106, 108, 128, 174, 176. The positions of the various components can be fixed through the use of set screws 104, 172.

FIG. 1 is further described in more specificity as a diagram of a casing floatation device before pressure activation, in accordance with some embodiments. The floatation device 100 includes a upper sub 102, where the upper sub 102 may include a pipe having a first end adapted to a casing string of a subsurface well. The upper sub 102 may be secured to the housing 110 via a fastener such as a set screw 104. The upper sub 102 may be secured to the housing 110 the other methods, such as via a threading, clamp, welded section, or the like. The housing 110 may include a wider housing segment 112, where the wider housing segment 112 has a greater inner diameter than the narrower housing segment 116. In some embodiments, the wider housing segment 112 may be connected to the narrower housing segment 116 via a transition housing segment 114. As shown in FIG. 1, in some embodiments, the transition housing segment 114 may be depicted as a tubular section or frustoconical surface having a changing inner diameter, where the inner diameter of the transition housing segment 114 changes linearly with respect to the axial direction of the housing 110. In some embodiments, the transition housing segment 114 may instead include a step change for the inner diameter with respect to the axial direction of the housing 110. For example, the transition housing segment 114 may include a shoulder where the inner diameter of the transition housing segment 114 is equal to the inner diameter of the wider housing segment 112 above the shoulder and is equal to the inner diameter of the narrower housing segment 116 below the shoulder.

In some embodiments, the housing 110 may include a piston 140 (sometimes referred to as sheath) within its inner volume or may include a portion of the piston 140 within its inner volume. The piston 140 may include a wider piston segment 142 and a narrower piston segment 146, where the wider piston segment 142 has a greater outer diameter than the narrower piston segment 146. The piston 140 may also include a transition piston segment 144, which may connect the wider piston segment 142 and the narrower piston segment 146. In some embodiments, the outer diameter of the transition piston segment 144 may be sloped, where the outer diameter changes linearly with respect to the axial direction of the piston 140. In some embodiments, the transition piston segment 144 may instead include a step change for the outer diameter with respect to the axial direction of the piston 140. For example, the transition piston segment 144 may include a shoulder where the inner diameter of the transition piston segment 144 is equal to the outer diameter of the wider piston segment 142 above the shoulder and is equal to the outer diameter of the narrower piston segment 146 below the shoulder.

In some embodiments, wider piston segment 142 may have an outer diameter that is approximately equal to the inner diameter of the wider housing segment 112, with such difference allowing for axial movement without significant pinching or frictional restraint. For example, some embodiments may include a wider piston segment 142 that is in physical contact with the wider housing segment 112. Alternatively, some embodiments may include wider piston segment 142 having an outer diameter that is less than the inner diameter of the wider housing segment 112. In some embodiments, the narrower piston segment 146 may have an outer diameter that is approximately equal to the inner diameter of the narrower housing segment 116, with such difference allowing for axial movement without significant pinching or frictional restraint. For example, some embodiments may include a narrower piston segment 146 that is in physical contact with the narrower housing segment 116. Alternatively, some embodiments may include a narrower piston segment 146 having an outer diameter that is less than the inner diameter of the narrower housing segment 116. Furthermore, in some embodiments, the outer profile of the transition piston segment 144 may be congruent with the inner profile of the transition housing segment 114. For example, if the outer profile of the transition piston segment 144 indicates a 1 mm per 1 cm increase in the outer diameter of the transition piston segment 144 with respect to an axial direction, the inner profile of the transition housing segment 114 may indicate a 1 mm per 1 cm decrease in the inner diameter of the transition housing segment 114 with respect to an increase in the same axial direction.

In some embodiments, the piston 140 may include a set of breaking pins 148 distributed across an annular end 143. In some embodiments, a breaking pin of the set of breaking pins 148 may include a base end 147 attached to the annular end 143 and a pin tip 149 having a narrower diameter than the base end of the breaking pin. For example, the base end 147 may have a circumference of 4 mm and the pin tip 149 may have a circumference of 1 mm. In some embodiments, a breaking pin of the set of breaking pins 148 may be physically separate from the annular end 143. For example, a breaking pin of the set of breaking pins 148 may include a steel stud that is installed on the annular end 143. Alternatively, or in addition, the annular end 143 may be shaped to form a breaking pin of the set of breaking pins 148. For example, the annular end 143 may be machined to include a protrusion, where the protrusion is a breaking pin of the set of breaking pins 148 or is otherwise shaped to deliver a significant force upon the brittle barrier 160 upon movement of the piston 140 such as by having a small surface area in the location of expected impact between the annular end 143 and the brittle barrier 160.

In some embodiments, the annular end 143 may face a brittle barrier 160, where the brittle barrier 160 may separate the fluids filling the volume of the inner bore section 101 from the fluids filling the volume of an inner bore section 103. For example, the fluids filling the volume of the inner bore section 101 may include water entity fluids or drilling mud and the fluid filling the volume of the inner bore section 103 may include air, where the brittle barrier 160 prevents the fluid of the volume of the inner bore section 101 from flowing into the volume of the inner bore section 103. The brittle barrier 160 may include one or more of various types of a shatterable material such as a glass material, a polycarbonite material, ceramic material, a brittle metal material, or like. For example, the brittle barrier 160 may include a polycarbonate material or other engineered material that may shatter into fragments smaller than 50 mm. Alternatively, or in addition, the brittle barrier 160 may include one or more prestressed zones that are positioned with respect to one or more of the set of breaking pins 148 to shatter when struck by the set of breaking pins 148. Alternatively, or in addition, the brittle barrier is scored in locations to facilitate breaking in desirable breaking locations and in desirable sizes. As discussed further below, in some embodiments, the impact of an impact surface, such as the set of protrusions or breaking pins 148 on the brittle barrier 160 may cause the brittle barrier 160 to shatter into fragments sufficiently small (e.g., less than 50 millimeters) as to allow the fragments to pass through other downhole equipment of a borehole. As further discussed below, by using the embodiments described above to shatter the brittle barrier 160, some embodiments may allow a bottomhole assembly to be used without a junk sub.

In certain embodiments, the transition piston segment 144 and the transition housing segment 114 are cooperatively shaped to act as a shoulder to stop motion of the piston 140 upon full activation of the piston 140 and its motion downstream. The distance between the transition housing segment 114 and the transition piston segment 144 should be equal to or less than the distance between the breaking pins 148 and the brittle barrier 160 to allow for sufficient stroke length of the piston 140 to provide an impact force between the breaking pins 148 and the brittle barrier 160, and subsequently halt the motion of the piston 140.

Figure 2:
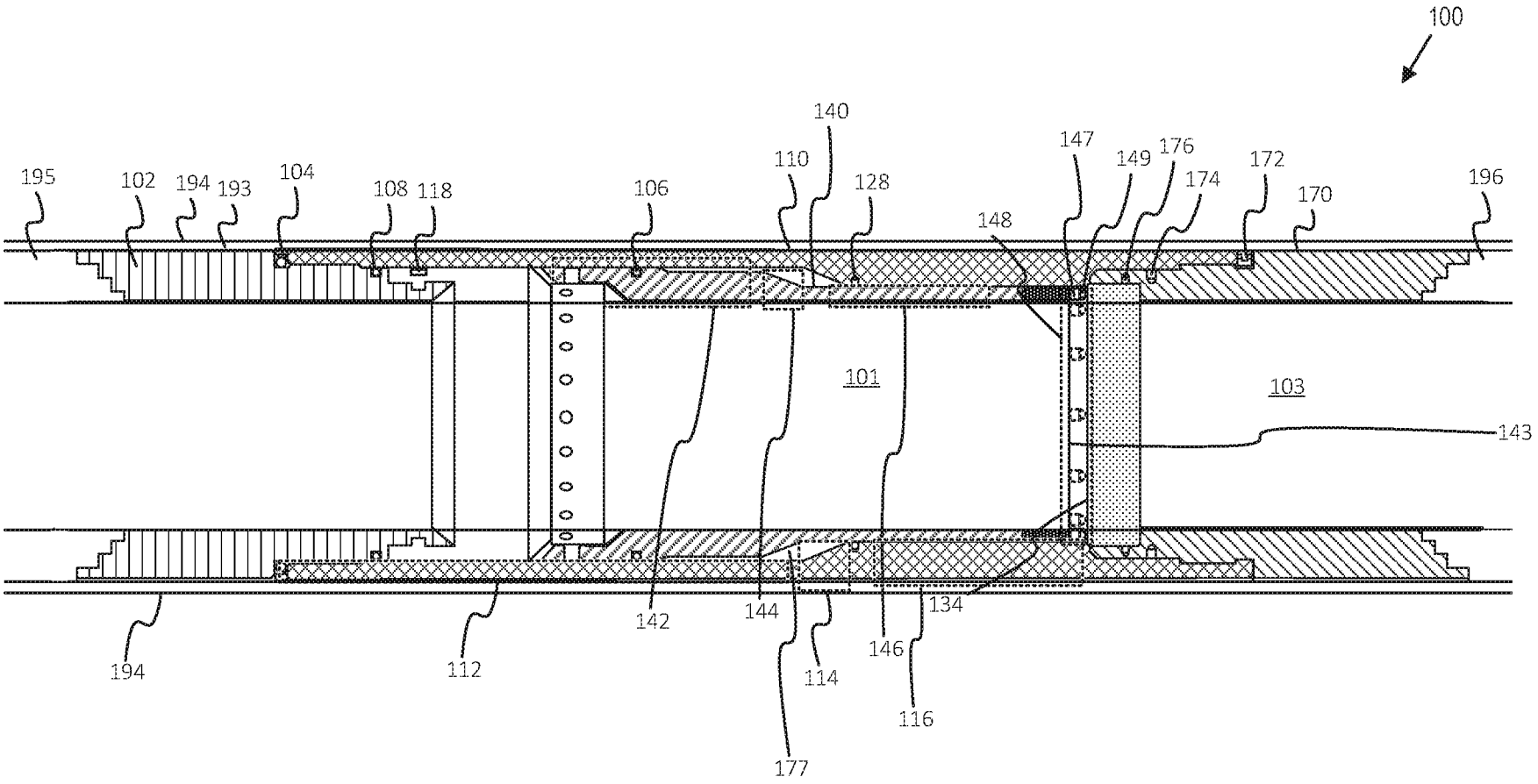
FIG. 2 is a diagram of a casing floatation device after pressure-induced shear, in accordance with some embodiments.

With respect to FIG. 2, the embodiment of FIG. 1 is shown after the shear screws 118 have been sheared and the piston 140 has moved into a partially forward position. In the embodiment shown, the drilling fluid within the volume of the inner bore section 101 may be pressurized such that the fluid pressure within the volume of the inner bore section 101 has increased to such a degree as to tend to collapse the hollow volume 177 formed by the space between the piston 140 and the housing 110. As described above, the shear screws 118 may receive a shear force upon increased pressurization of the fluid within the volume of the inner bore section 101. In some embodiments the shear screws 118 are sized and positioned to shear at 500 psi. In such embodiments, the shear force necessary on the shear screws 118 necessary to activate the piston 140 can be a multiple of 500 psi equal to the number of shear screws 118 utilized, such increase in pressure caused by pumps typically at the surface and controlled by an operator. In certain other embodiments, the brittle barrier is pre-determined to have a threshold for shattering to allow a backup mechanism for shattering the brittle barrier in the event the piston 140 fails to activate, fails to shatter, or otherwise fails to sufficiently place the upper and lower bore in fluid communication. In some embodiments, the brittle barrier pressure threshold is on the order of 8000 psi-9000 psi or less. In these embodiments, the differential pressure between volume of the inner bore section 101 and the hollow volume 177 tends to collapse the hollow volume 177, which may move transition piston segment 144 toward transition housing segment 114 until such transition segments 144, 114 are seated upon each other. The piston 140 is in a forward position such that the breaking pins 148 have initiated contact on brittle barrier 160 on its upstream surface 134.

Figure 3:
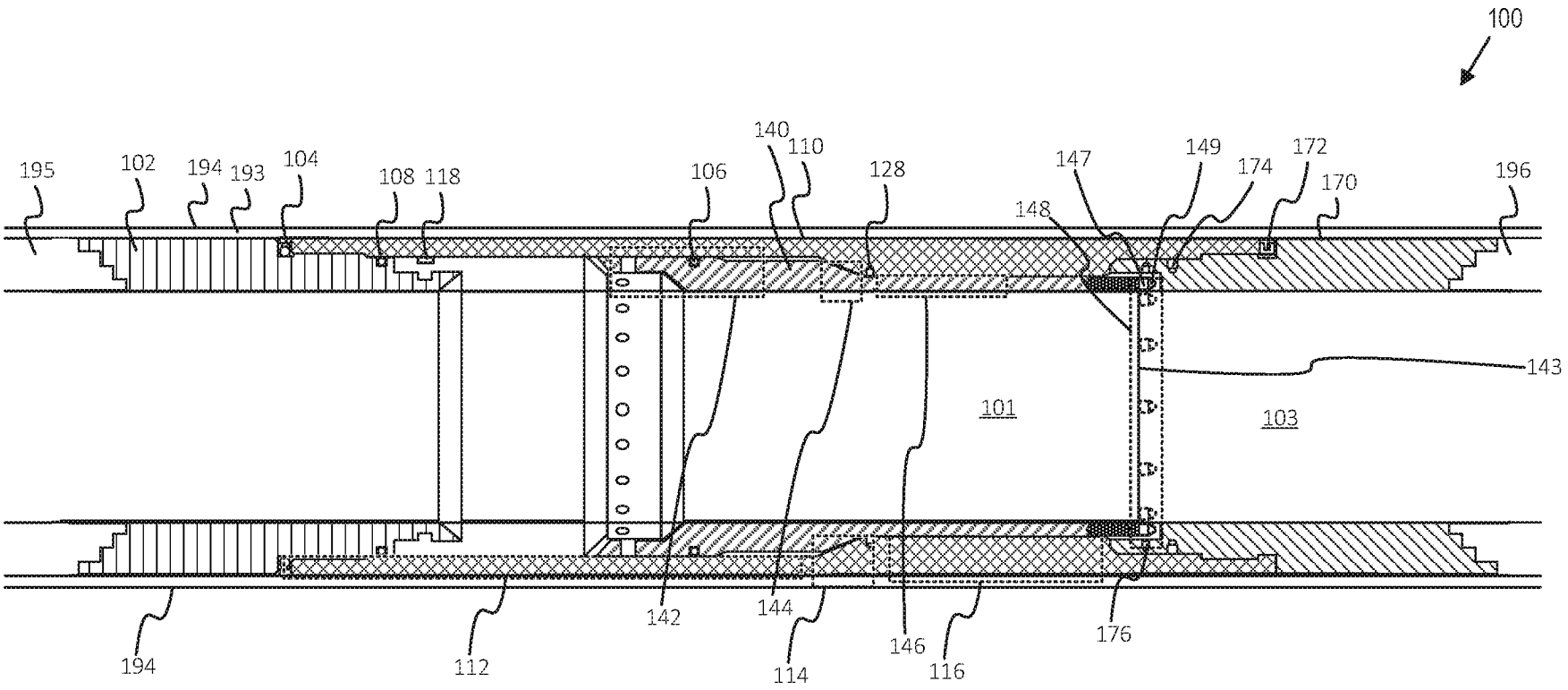
FIG. 3 is a diagram of a casing floatation device after shattering of a brittle barrier of the casing floatation device, in accordance with some embodiments.

With respect to FIG. 3, the embodiment of FIG. 1 and FIG. 2 is shown with the piston 140 in its forwardmost position after activation. In this figure, piston 140 is prevented from additional downstream movement because transition piston segment 144 is seated upon transition housing segment 114. In this embodiment, the inner diameter of piston 140 is approximately continuous with the inner diameter of the lower sub 170. This approximately equal inner diameter between the components 140, 170 can create a smooth, continuous surface to facilitate passing tools through the volumes of the inner bore sections 101 and 103 while minimizing the potential of snagging on discontinuous surfaces. This combined inner diameter is preferably equal to or greater than the inner diameter of the remainder of the production string and the upper sub 102 to maximize the size of the tools to be passed downstream, where the upper sub 102 and the combined inner diameter presents minimal hang-ups for tools. In this figure, there is no brittle barrier 160, the brittle barrier 160 having been broken by the impact with the piston 140, causing flow from high pressure fluid in the volume of the inner bore section 101 toward the volume of the inner bore section 103, and the pieces of the brittle barrier having been washed downstream. Preferably, the impact upon the brittle barrier 160 results in shattering into small pieces, preferable less than 50 mm. In many embodiments, preferably the pieces of the brittle barrier 160 are small enough that they can flow out the distal end of the string, or out a toe valve, or out a tool providing communication between the volumes of the inner bore sections 101 and 103 and the annulus 193 surrounding the line without the use of a junk sub.

Figure 4:
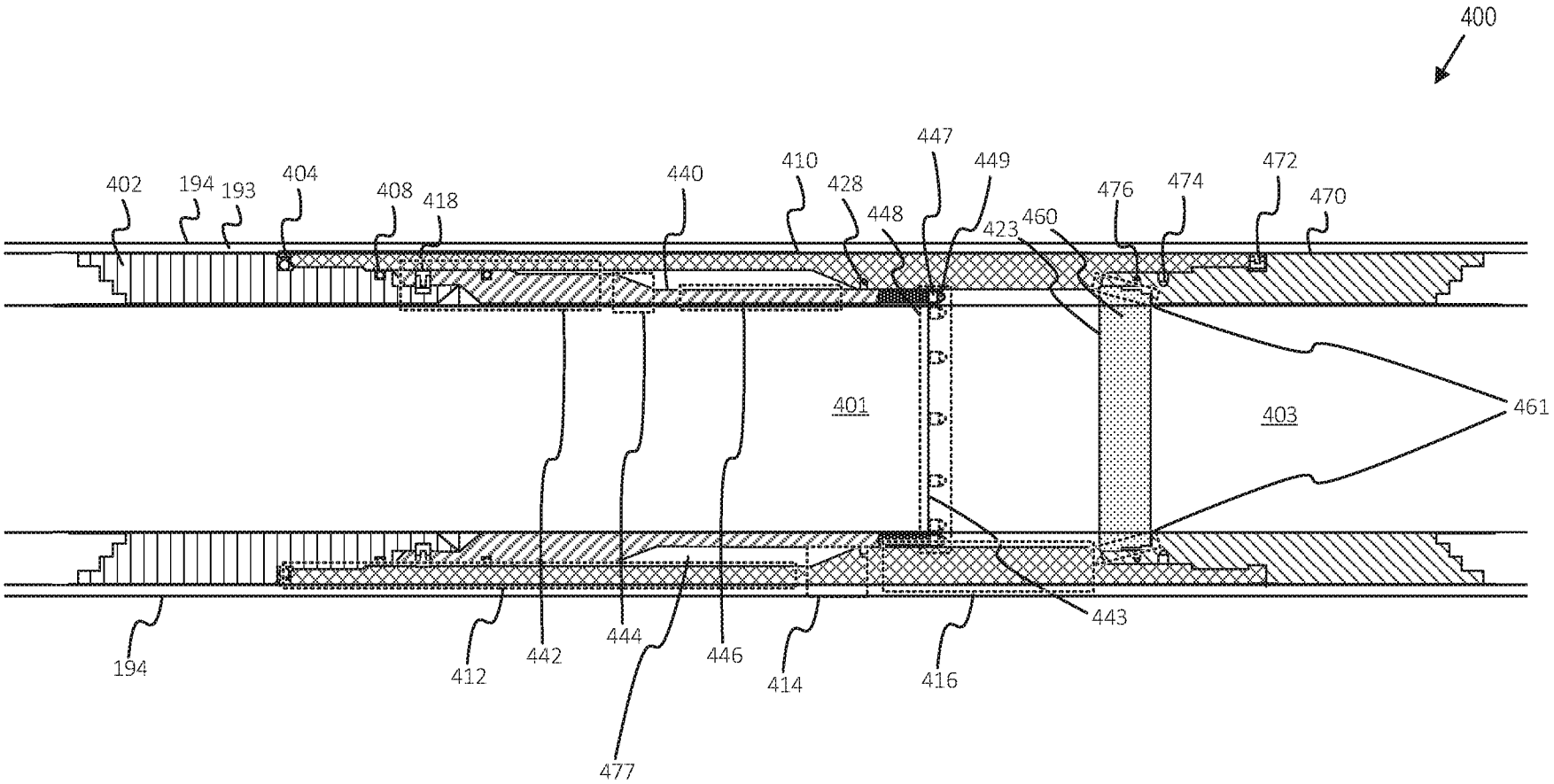
FIG. 4 is a diagram of a casing floatation device with a tapered brittle barrier, in accordance with some embodiments.

FIG. 4 shows a different embodiment under the teachings of this disclosure. Brittle barrier 460 is positioned such that it is not parallel with the inner walls of the inner bore sections 401 or 403 of the floatation device 400. In some embodiments, the brittle barrier 460 may include surfaces that are tapered along a line 461 such that the surface of the brittle barrier 460 is a conic section. In some embodiments, the tapering edges of the brittle barrier 460 may provide advantages such as a lower impact force necessary to shatter the brittle barrier 460 and easier construction when seating the brittle barrier during assembly. The line 461, like all parts of the figures herein, is not necessarily to scale, and the taper can range from approximately −45° to 45°. In some embodiments the taper is not linear and in some embodiments the taper varies along the length of the brittle barrier.

In some embodiments, the brittle barrier 460 may be seated on the lower sub 470 such that an upstream face 423 of the brittle barrier 460 is not perpendicular with the axial direction of the tool and instead the upstream face 423 is angled between 1° and 45° off the axial direction. In certain of these embodiments, the lower sub 470 may be similarly shaped to have a shoulder that cooperates with the brittle barrier 160 at the selected angle. In some embodiments, this orientation may expose the brittle barrier to a single or few breaking pins 448 at initial contact, which may reduce the surface area of impact and increasing the force on the brittle barrier. In some embodiments, such angled orientations may provide advantages in the form of increase control during failure of a brittle barrier. Furthermore, while the above is described with respect to a brittle barrier 460, other embodiments may include an angled brittle barrier having non-tapered surfaces.

Figure 5:
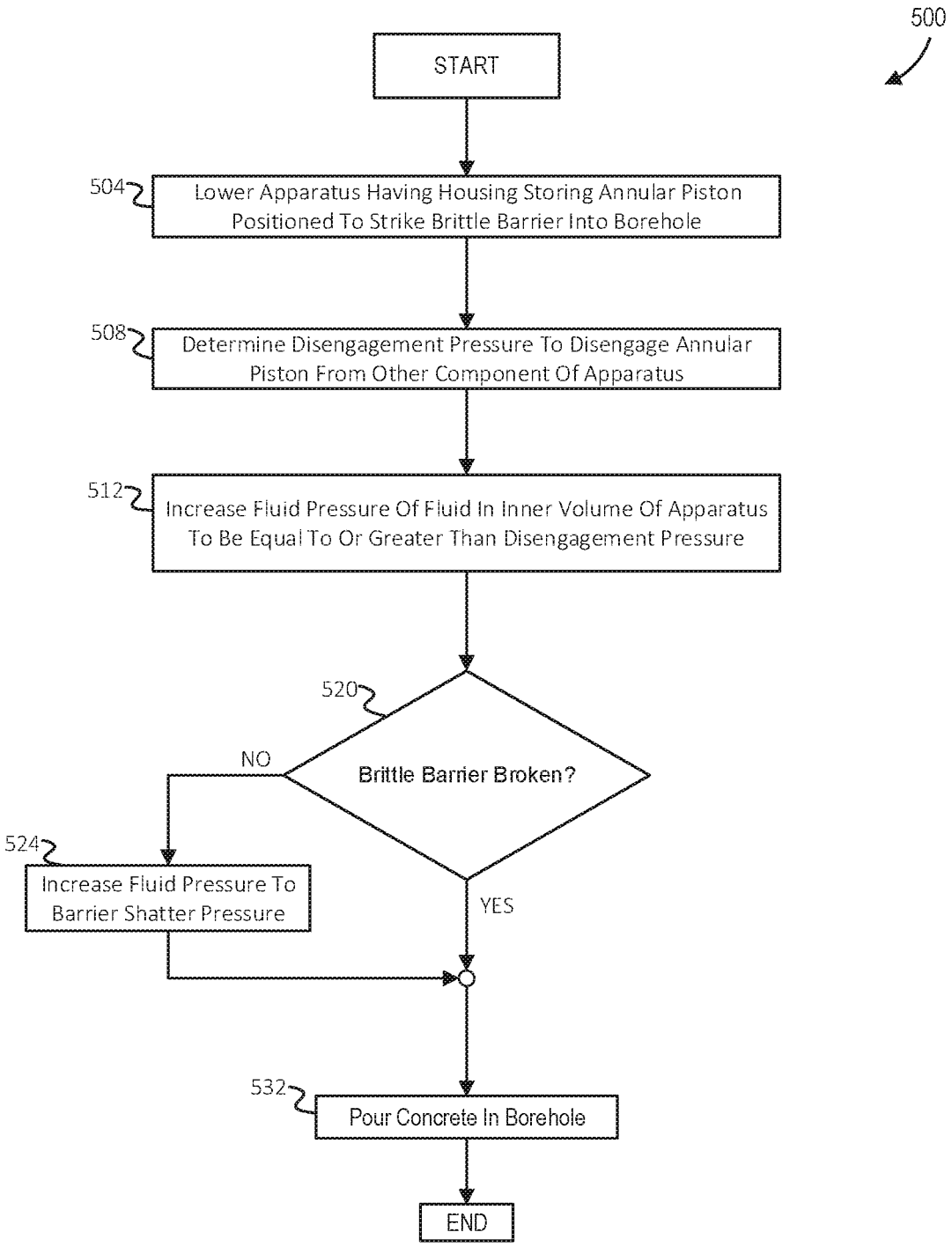
FIG. 5 is a flowchart of a process by which the floatation device may be used, in accordance with some embodiments.

FIG. 5 is a flowchart of a process by which the floatation device may be used, in accordance with some embodiments. In certain embodiments, the tool under the teachings herein is lowered having a sheath and annular pipe into a borehole 504. A disengagement pressure which may be applied to activate the fluid communication between the upstream and downstream direction of the tool, is determined 508. In some embodiments, the disengagement pressure may be determined based on a stress value (e.g., rated shear stress) provided with a floatation tool, corresponding to one or more fasteners of the floatation device or a number of fasteners.

Alternatively, or in addition, the disengagement pressure may be determined based on on-site computations determined based on component specifications (e.g., shear stress, number of fasteners, or the like), where the computations may include operations to balance on-site components to physical force such as friction, pipe weight, fluid weight, or the like. The pressure is increased in the internal fluids by, for example, increasing pump pressure to the disengagement pressure associated with fasteners that may attach the sheath to the annular pipe, such as shear pins 512. After disengagement of the sheath, the brittle barrier may be destroyed, as discussed elsewhere 520. The brittle barrier destruction can be determined in a number of ways, including a sudden drop of pressure and a sudden increase in flow rate of the internal fluids 524. If the brittle barrier is destroyed, the line can be used as ordinary with fluid flow throughout 532, including the delivery of concrete downhole, delivery of darts downhole, circulation of drilling fluid, delivery of tools, and circulation of pumped oil to the surface. Otherwise, pressure is increased until the brittle barrier is shattered.

In some embodiments, the process 500, like the other processes and functionality described herein, may be implemented by a system that includes computer code stored on a tangible, non-transitory, machine-readable medium, such that when instructions of the code are executed by one or more processors, the described functionality may be effectuated. This may be implemented based on telemetry, pressure, flow rate and other readings downhole communicated to a collocated or distant computer or computers to proceed through some or all of the actions of the described method. Instructions may be distributed on multiple physical instances of memory, e.g., in different computing devices, or in a single device or a single physical instance of memory, all consistent with use of the singular term "medium." In some embodiments, the system may include a computing device of a pump that stores or executes some or all of the computer code to perform one or more operations described below. In some embodiments, the entirety of the process is enacted by human and mechanical means without involvement of computing devices. In certain other embodiments, certain of the steps are carried out by mechanical and human means, and certain of the steps are carried out with involvement of computing devices, such as a computer controlled pump to increase pressure within the annulus of the device.

In some embodiments, the operations may be executed in a different order from that described. For example, the system may determine the disengagement pressure 508 prior to lowering the apparatus into the borehole 504. In some embodiments, operations may be executed multiple times per instance of the process's execution, such as multiple determinations of disengagement pressure based on various inputs, such as environmental factors, geometry, and positioning such that disengagement pressure changes, some operations may be omitted, additional operations may be added, some operations may be executed concurrently and other operations may be executed serially, none of which is to suggest that any other feature described herein is not also amenable to variation. For example, some embodiments may omit executing operations described in block 532 and no subsequent pouring of concrete is necessary or useful for the operations of the device in question in a particular use.

Figure 6:
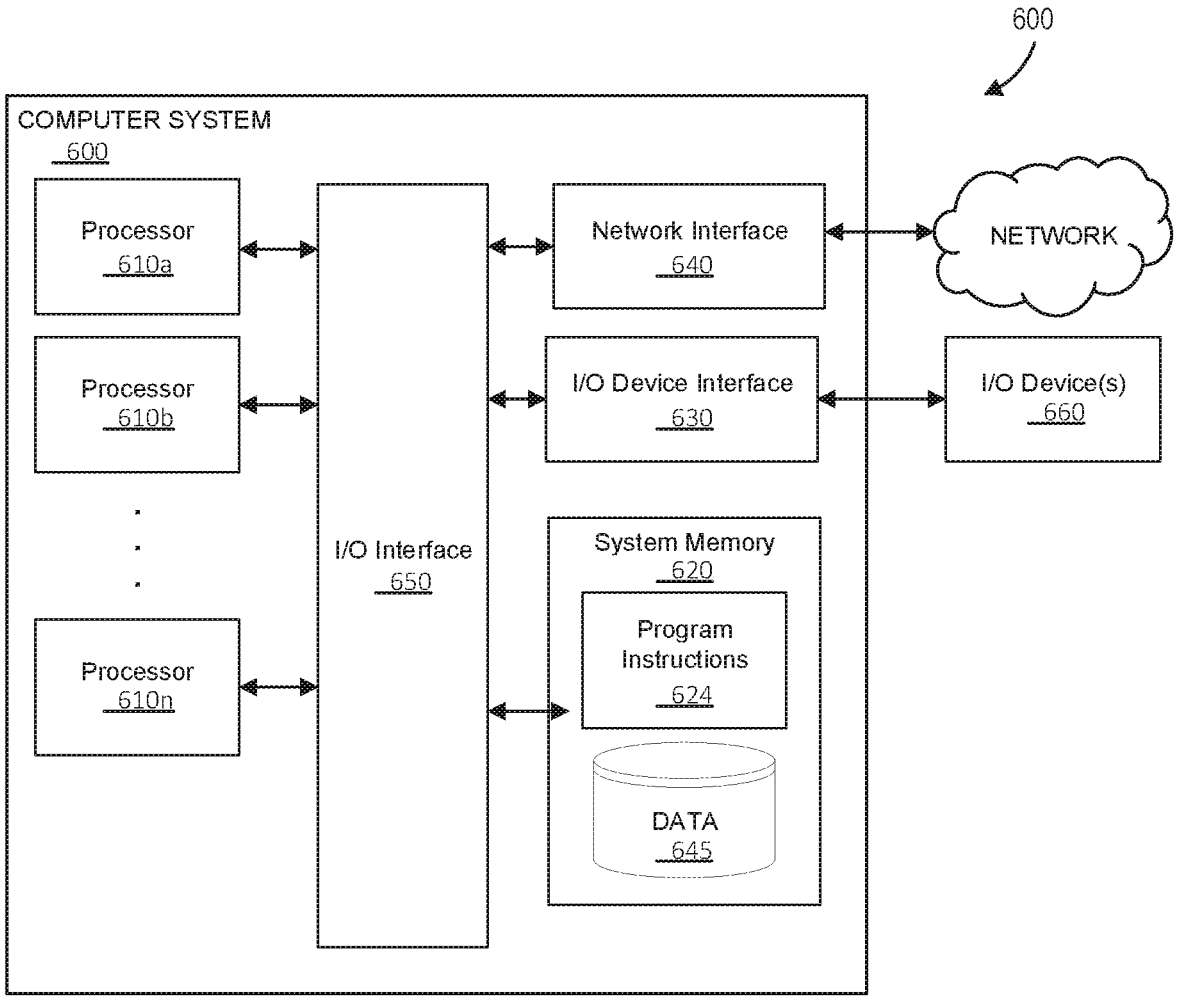
FIG. 6 shows an example of a computing device by which the present techniques may be implemented, in accordance with some embodiments.

FIG. 6 shows an exemplary computer system 600 by which the present techniques may be implemented in accordance with some embodiments. Various portions of systems and methods described herein, may include or be executed on one or more computer systems similar to computer system 600. Further, processes and modules described herein may be executed by one or more processing systems similar to that of computer system 600.

Computer system 600 may include one or more processors (e.g., processors 610*a*-610*n*) coupled to system memory 620, an input/output I/O device interface 630, and a network interface 640 via an input/output (I/O) interface 650. A processor may include a single processor or a plurality of processors (e.g., distributed processors). A processor may be any suitable processor capable of executing or otherwise performing instructions. A processor may include a central processing unit (CPU) that carries out program instructions to perform the arithmetical, logical, and input/output operations of computer system 600. A processor may execute code (e.g., processor firmware, a protocol stack, a database management system, an operating system, or a combination thereof) that creates an execution environment for program instructions. A processor may include a programmable processor. A processor may include general or special purpose microprocessors. A processor may receive instructions and data from a memory (e.g., system memory 620). Computer system 600 may be a uni-processor system including one processor (e.g., processor 610*a*), or a multi-processor system including any number of suitable processors (e.g., 610*a*-610*n*). Multiple processors may be employed to provide for parallel or sequential execution of one or more portions of the techniques described herein. Processes, such as logic flows, described herein may be performed by one or more programmable processors executing one or more computer programs to perform functions by operating on input data and generating corresponding output. Processes described herein may be performed by, and apparatus can also be implemented as, special purpose logic circuitry, e.g., a vision processing unit (VPU), a neuromorphic complementary metal-oxide-semiconductor (CMOS) chip, an FPGA (field programmable gate array), a PGA (programmable gate array), or an ASIC (application specific integrated circuit) such as a tensor processing unit (TPU). Computer system 600 may include a plurality of computing devices (e.g., distributed computer systems) to implement various processing functions.

I/O device interface 630 may provide an interface for connection of one or more I/O devices 660 to computer system 600. I/O devices may include devices that receive input (e.g., from a user) or output information (e.g., to a user). I/O devices 660 may include, for example, graphical user interface presented on displays (e.g., a cathode ray tube (CRT) or liquid crystal display (LCD) monitor), pointing devices (e.g., a computer mouse or trackball), keyboards, keypads, touchpads, scanning devices, voice recognition devices, gesture recognition devices, printers, audio speakers, microphones, cameras, or the like. I/O devices 660 may be connected to computer system 600 through a wired or wireless connection. I/O devices 660 may be connected to computer system 600 from a remote location. I/O devices 660 located on remote computer system, for example, may be connected to computer system 600 via a network and network interface 640.

Network interface 640 may include a network adapter that provides for connection of computer system 600 to a network. Network interface 640 may facilitate data exchange between computer system 600 and other devices connected to the network. Network interface 640 may support wired or wireless communication. The network may include an electronic communication network, such as the Internet, a local area network (LAN), a wide area network (WAN), a cellular communications network, or the like.

System memory 620 may be configured to store program instructions 624 or data 645. Program instructions 624 may be executable by a processor (e.g., one or more of processors 610*a*-610*n*) to implement one or more embodiments of the present techniques. Program instructions 624 may include modules of computer program instructions for implementing one or more techniques described herein with regard to various processing modules. Program instructions may include a computer program (which in certain forms is known as a program, software, software application, script, or code). A computer program may be written in a programming language, including compiled or interpreted languages, or declarative or procedural languages. A computer program may include a unit suitable for use in a computing environment, including as a stand-alone program, a module, a component, or a subroutine. A computer program may or may not correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one or more computer processors located locally at one site or distributed across multiple remote sites and interconnected by a communication network.

System memory 620 may include a tangible program carrier having program instructions stored thereon. A tangible program carrier may include a non-transitory computer readable storage medium. A non-transitory computer readable storage medium may include a machine readable storage device, a machine readable storage substrate, a memory device, or any combination thereof. Non-transitory computer readable storage medium may include non-volatile memory (e.g., flash memory, ROM, PROM, EPROM, EEPROM memory), volatile memory (e.g., random access memory (RAM), static random access memory (SRAM), synchronous dynamic RAM (SDRAM)), bulk storage memory (e.g., CD-ROM and/or DVD-ROM, hard-drives), or the like. System memory 620 may include a non-transitory computer readable storage medium that may have program instructions stored thereon that are executable by a computer processor (e.g., one or more of processors 610*a*-610*n*) to cause the subject matter and the functional operations described herein. A memory (e.g., system memory 620) may include a single memory device and/or a plurality of memory devices (e.g., distributed memory devices). Instructions or other program code to provide the functionality described herein may be stored on a tangible, non-transitory computer readable media. In some cases, the entire set of instructions may be stored concurrently on the media, or in some cases, different parts of the instructions may be stored on the same media at different times.

I/O interface 650 may be configured to coordinate I/O traffic between processors 610*a*-610*n*, system memory 620, network interface 640, I/O devices 660, and/or other peripheral devices. I/O interface 650 may perform protocol, timing, or other data transformations to convert data signals from one component (e.g., system memory 620) into a format suitable for use by another component (e.g., processors 610*a*-610*n*). I/O interface 650 may include support for devices attached through various types of peripheral buses, such as a variant of the Peripheral Component Interconnect (PCI) bus standard or the Universal Serial Bus (USB) standard.

Embodiments of the techniques described herein may be implemented using a single instance of computer system 600 or multiple computer systems 600 configured to host different portions or instances of embodiments. Multiple computer systems 600 may provide for parallel or sequential processing/execution of one or more portions of the techniques described herein.

Those skilled in the art will appreciate that computer system 600 is merely illustrative and is not intended to limit the scope of the techniques described herein. Computer system 600 may include any combination of devices or software that may perform or otherwise provide for the performance of the techniques described herein. For example, computer system 600 may include or be a combination of a cloud-computer system, a data center, a server rack, a server, a virtual server, a desktop computer, a laptop computer, a tablet computer, a server device, a client device, a mobile telephone, a personal digital assistant (PDA), a mobile audio or video player, a game console, a vehicle-mounted computer, or a Global Positioning System (GPS), or the like. Computer system 600 may also be connected to other devices that are not illustrated, or may operate as a stand-alone system. In addition, the functionality provided by the illustrated components may in some embodiments be combined in fewer components or distributed in additional components. Similarly, in some embodiments, the functionality of some of the illustrated components may not be provided or other additional functionality may be available.

Those skilled in the art will also appreciate that while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 600 may be transmitted to computer system 600 via transmission media or signals such as electrical, electromagnetic, or digital signals, sent via a communication medium such as a network or a wireless link. Various embodiments may further include receiving, sending, or storing instructions or data implemented in accordance with the foregoing description upon a computer-accessible medium. Accordingly, the present techniques may be practiced with other computer system configurations.

In block diagrams, illustrated components are depicted as discrete functional blocks, but embodiments are not limited to systems in which the functionality described herein is organized as illustrated. The functionality provided by each of the components may be provided by software or hardware modules that are differently organized than is presently depicted, for example such software or hardware may be intermingled, conjoined, replicated, broken up, distributed (e.g., within a data center or geographically), or otherwise differently organized. The functionality described herein may be provided by one or more processors of one or more computers executing code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information sent over networks, in which case, to the extent information (e.g., content) is said to be supplied or otherwise provided, the information may provided by sending instructions to retrieve that information from a content delivery network.

The reader should appreciate that the present application describes several independently useful techniques. Rather than separating those techniques into multiple isolated patent applications, applicants have grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Similarly, reference to "a computer system" performing step A and "the computer system" performing step B can include the same computing device within the computer system performing both steps or different computing devices within the computer system performing steps A and B. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation. As is the case in ordinary usage in the field, data structures and formats described with reference to uses salient to a human need not be presented in a human-intelligible format to constitute the described data structure or format, e.g., text need not be rendered or even encoded in Unicode or ASCII to constitute text; images, maps, and data-visualizations need not be displayed or decoded to constitute images, maps, and data-visualizations, respectively; speech, music, and other audio need not be emitted through a speaker or decoded to constitute speech, music, or other audio, respectively. Computer implemented instructions, commands, and the like are not limited to executable code and can be implemented in the form of data that causes functionality to be invoked, e.g., in the form of arguments of a function or API call.

In this patent, certain U.S. patents, U.S. patent applications, or other materials (e.g., articles) have been incorporated by reference. The text of such U.S. patents, U.S. patent applications, and other materials is, however, only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

What is claimed is:

1. An apparatus comprising:

a first outer pipe;

a central housing attached to the first outer pipe, an annular piston having a first end and a second end, the annular piston positioned at least in part inside the central housing, the annular piston comprising an impact surface;

a brittle barrier, wherein the brittle barrier is separated from the impact surface by a distance, wherein the brittle barrier comprises a set of materials, wherein the brittle barrier comprises a surface that is tilted within the central housing such that a first portion of a circumference of the brittle barrier is positioned upstream from a second portion of the circumference of the brittle barrier, and wherein the impact surface contacts the first portion before the second portion, which focuses the application of force, thereby facilitating breaking the brittle barrier; and a second outer pipe attached to the central housing, wherein the central housing is positioned between the first outer pipe and the second outer pipe;

wherein the brittle barrier is positioned within one or more of the central housing and the second outer pipe;

wherein the annular piston is attached to one or more of the first outer pipe and the central housing via a releasable fastener; and wherein the piston is moveable from a first position to a second position, the first position a distance from the brittle barrier and the second position resulting in an application of force from the impact surface to the brittle barrier.

2. The apparatus of claim 1, wherein:

the central housing comprises a transition housing segment between a wider housing segment of the central housing and a narrower housing segment of central housing, wherein the inner diameter of the transition housing segment is less than the first inner diameter and greater than the second inner diameter; and the annular piston comprises a transition piston segment between a wider piston segment of the annular piston and a narrower piston segment of the annular piston, wherein the outer diameter of the transition piston segment is greater than the first outer diameter and less the second outer diameter.

3. The apparatus of claim 1, further comprising an inner bore within the central housing, first outer pipe, and second outer pipe wherein the annular piston and the central housing are shaped such that an empty space is formed between them, wherein the empty space is in fluid isolation from the inner bore.

4. The apparatus of claim 3, wherein the fasteners are releasable by an increase in pressure within the inner bore.

5. The apparatus of claim 1, further comprising a frame, wherein the frame surrounds the brittle barrier.

6. The apparatus of claim 1, wherein the fasteners are releasable at a first pressure and the brittle barrier comprises a material that shatters at a pressure greater than the first pressure and less than 9000 psi.

7. The apparatus of claim 1, wherein the brittle barrier comprises an engineered glass that shatters into glass particulates, and wherein at least 10% of the glass particulates have a grain size less than 50 millimeters.

8. The apparatus of claim 1, wherein the impact surface comprises a set of protrusions, the protrusions comprising a plurality of metal pins, wherein each pin has a tip and a base, wherein the tip of each respective metal pin is narrower than the base of each respective metal pin.

9. The apparatus of claim 1, wherein the fastener is a shear pin.

10. The apparatus of claim 1, wherein the brittle barrier is fixed to the central housing or the second outer pipe.

11. The apparatus of claim 1, wherein the fastener releases at a pressure less than 8000 psi.

12. The apparatus of claim 1, wherein the impact surface comprises a set of protrusions, the set of protrusions formed of the same material as the annular piston.

13. A method comprising:

determining a disengagement pressure based on a set of fasteners that attaches an annular piston to an annular housing or a first outer pipe, wherein;

the annular piston is positioned at least in part inside an annular housing or a first outer pipe, the annular piston comprising:

an opening at a first end of the annular piston that permits a fluid to flow into a hollow volume of the annular piston, an opening at a second end of the annular piston that is permeable to fluids, and a set of protrusions attached to the second end of the annular piston facing away from the first end of the annular piston; and increasing a fluid pressure in the annular housing to be equal to or greater than the disengagement pressure to cause a disengagement of the annular piston from the annular housing or the first outer pipe, wherein:

the increasing of the fluid pressure increases a net force experienced by the annular piston, and the disengagement of the annular piston from the annular housing or the first outer pipe permits the annular piston to move in a first direction that points from an axial position of the first end of the annular piston to an axial position of the second end of the annular piston to strike a brittle barrier with the set of protrusions, wherein the strike causes the brittle barrier to shatter, wherein the brittle barrier comprises a surface that is tilted within the annular housing such that a first portion of a circumference of the brittle barrier is positioned upstream from a second portion of the circumference of the brittle barrier, and wherein the impact surface contacts the first portion before the second portion, which focuses the application of force, thereby facilitating breaking the brittle barrier.

14. The method of claim 13, further comprising:

determining whether the brittle barrier was shattered after the disengagement of the annular piston from the annular housing; and in response to a determination that the brittle barrier was not shattered after the disengagement of the brittle pipe, increasing the fluid pressure in the annular housing to be equal to or greater than a shatter pressure associated with the brittle barrier, wherein the shatter pressure is greater than the disengagement pressure.

15. The method of claim 13, further comprising:

determining whether the brittle barrier was shattered; and in response to a determination that the brittle barrier was shattered, pouring cement into the borehole.

16. The method of claim 13, wherein increasing the fluid pressure causes the brittle material to shatter into particles such that the majority of particles have a maximum diameter less than or equal to 50 millimeters.

17. A downhole system, comprising:

a first outer pipe in a downhole environment, wherein the first outer pipe is filled with a liquid;

a central housing attached to the first outer pipe;

an annular piston with a central bore, the annular piston positioned at least in part inside the central housing, and wherein the annular piston is attached to the central housing or the first outer pipe via a fastener, the annular piston and the central housing cooperatively shaped to form a hollow section in fluid isolation from the central bore, the annular piston comprising:

an annular surface that at a second end of the annular piston, and an impact surface facing toward a brittle barrier;

wherein the brittle barrier is in contact with the central housing or a second outer pipe, wherein the brittle barrier is separated from the impact surface by a distance, wherein the brittle barrier comprises a set of materials, wherein the brittle barrier comprises a surface that is tilted within the central housing such that a first portion of a circumference of the brittle barrier is positioned upstream from a second portion of the circumference of the brittle barrier, and wherein the impact surface contacts the first portion before the second portion, which focuses the application of force, thereby facilitating breaking the brittle barrier;

a set of second outer pipes engaged to the central housing at an end of the central housing pipe that is opposite to the first outer pipe, wherein each of the set of second outer pipes is filled with one or more gases; and an assembly attached to the set of second outer pipes, wherein the assembly is adapted to prevent fluid flow into the second outer pipes.

18. The system of claim 17, wherein an increase in pressure detaches the annular piston from the first outer pipe or the central housing.

19. The apparatus of claim 1, wherein the brittle barrier is tilted from about 1 degree to about 45 degrees.

* * * * *